US008783253B2

(12) United States Patent
Flaherty

(10) Patent No.: US 8,783,253 B2
(45) Date of Patent: Jul. 22, 2014

(54) DECORATIVE COVER FOR A RESPIRATOR MASK

(75) Inventor: Ann Elizabeth Randol Flaherty, Cincinnati, OH (US)

(73) Assignee: Meridian Medical LLC, Cincinnati, OH (US)

( * ) Notice: Subject to any disclaimer, the term of this patent is extended or adjusted under 35 U.S.C. 154(b) by 840 days.

(21) Appl. No.: 12/712,302

(22) Filed: Feb. 25, 2010

(65) Prior Publication Data

US 2010/0218774 A1 Sep. 2, 2010

Related U.S. Application Data

(60) Provisional application No. 61/156,054, filed on Feb. 27, 2009.

(51) Int. Cl.
*A62B 18/08* (2006.01)

(52) U.S. Cl.
USPC ..... 128/206.13

(58) Field of Classification Search
USPC ..... 128/206.12–206.19, 863; 2/244, 249
See application file for complete search history.

(56) References Cited

U.S. PATENT DOCUMENTS

| | | | | |
|---|---|---|---|---|
| 2,067,026 | A | | 1/1937 | Schwartz |
| 2,070,754 | A | | 2/1937 | Schwartz |
| 2,296,775 | A | | 9/1942 | Dockson |
| 4,090,510 | A | | 5/1978 | Segersten |
| 4,300,549 | A | * | 11/1981 | Parker ..... 128/206.19 |
| 4,520,509 | A | | 6/1985 | Ward |
| D368,960 | S | | 4/1996 | Lanford |
| 5,603,317 | A | | 2/1997 | Farmer |
| 6,070,578 | A | * | 6/2000 | Baughman et al. ..... 128/205.27 |
| D440,302 | S | * | 4/2001 | Wolfe ..... D24/110.1 |
| 6,945,249 | B2 | | 9/2005 | Griesbach, III et al. |
| D511,209 | S | | 11/2005 | Callan |
| 7,017,577 | B2 | | 3/2006 | Matich |
| 7,107,628 | B2 | | 9/2006 | Haaga |
| 2004/0031490 | A1 | | 2/2004 | Haaga |
| 2006/0087832 | A1 | * | 4/2006 | Peng et al. ..... 362/103 |
| 2007/0044802 | A1 | | 3/2007 | Horne et al. |
| 2008/0230066 | A1 | | 9/2008 | Chandaria |

OTHER PUBLICATIONS

Guidespot, by The Mean Bean, Swine Flu and other reasons to wear a surgical mask! [online], at least as early as Apr. 28, 2009 [retrieved on May 5, 2009]. Retrieved from the Internet: <URL: http://www.guidespot.com/guides/ep1/print>.

* cited by examiner

*Primary Examiner* — Nathan R Price
(74) *Attorney, Agent, or Firm* — Wood, Herron & Evans, LLP

(57) ABSTRACT

A decorative cover for a respirator mask includes a fabric panel formed from substantially non-filtering fabric material. A first fastener is attached to an interior surface on the fabric panel, and a second fastener is attached to an exterior surface of the respirator mask. The first and second fasteners releasably engage with each other to couple the fabric panel to the respirator mask.

8 Claims, 1 Drawing Sheet

DECORATIVE COVER FOR A RESPIRATOR MASK

The present application claims the filing benefit of U.S. Provisional Application Ser. No. 61/156,054, filed Feb. 27, 2009, the disclosure of which is hereby incorporated herein by reference in its entirety.

FIELD OF THE INVENTION

This invention relates to safety apparel, and more specifically, to respirator masks.

BACKGROUND OF THE INVENTION

In many hospitals and doctor's offices, medical personnel wear respirator masks for safety reasons. The respirator mask covers the nose and mouth of a doctor or nurse, protecting them from airborne infections and diseases. Furthermore, patients and their family and friends visiting in the hospital commonly wear respirator masks to protect themselves from contracting or spreading an infection. Respirator masks serve an important purpose in preventing the spread of infectious diseases around a hospital and into the general public. In alternative settings, respirator masks are adapted to protect the user from harmful particles in the air related to the setting. For example, respirator masks are used commonly in the painting industry as well as by international travelers.

Returning to the hospital setting, patients and visitors sometimes resist the use of these respirator masks for a number of reasons. The respirator masks are certainly not very fashionable. Furthermore, a room full of visitors wearing respirator masks can be intimidating or even scary for younger patients. A patient who wears a respirator mask all the time may feel insecure about their appearance. All of these reasons could lead a person to not wear the respirator mask, which may have dire consequences if the infection spreads to the patient or general public as a result. Thus, it would be desirable to improve the appearance of a respirator mask.

SUMMARY OF THE INVENTION

The present invention overcomes the foregoing and other shortcomings and drawbacks of respirator masks heretofore known. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, a decorative cover for a respirator mask includes a fabric panel formed from a substantially non-filtering fabric material that is releasably attachable to a respirator mask. The decorative cover and respirator mask are provided with fasteners so that the cover may be easily attached to, and removed from, the mask to facilitate changing of the cover with a different cover and/or washing or sterilization of the cover after its use. The fabric panel may include a decorative design on its exterior surface so as to improve the appearance of the decorative cover and the underlying respirator mask.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
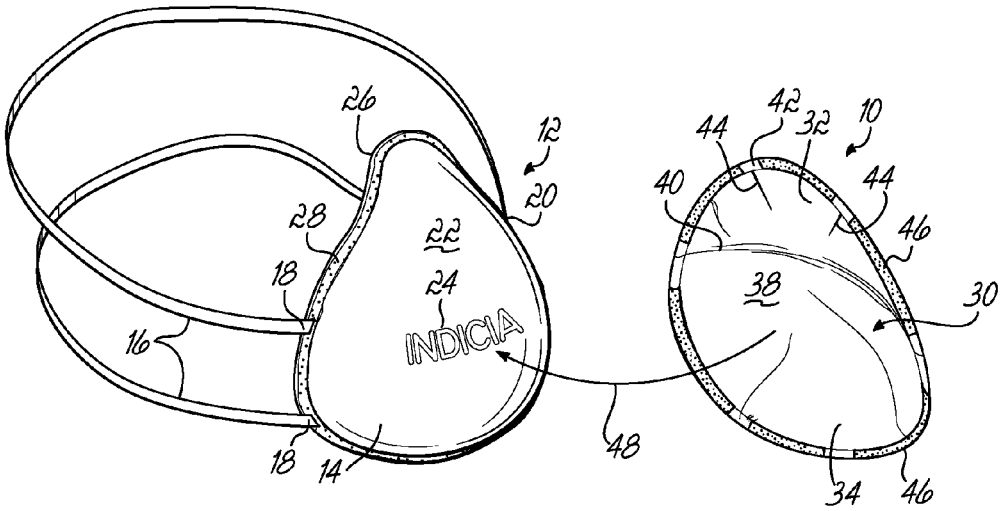
FIG. 1 is a perspective view of a decorative cover and respirator mask according to one embodiment of the present invention, showing the cover and mask disengaged from each other.

Referring now to the figures, a decorative cover 10 and respirator mask 12 according to one embodiment of the present invention are illustrated in FIG. 1. The respirator mask 12 includes a filter panel 14 formed from a filter fabric or material that is designed to filter airborne particles as air is drawn through the mask. The filter fabric may be any high density fabric known in the art to efficiently filter out airborne particles such as airborne infectious particles. Alternatively, the filter fabric may include electrically charged fibers or chemically absorptive fibers that block or absorb any airborne particles. The respirator mask 12 also includes an elastic band 16 with first and second ends 18, 20 attached to opposing side edges of the filter panel 14. The elastic band 16 is adapted to stretch over a user's head while the filter panel 14 is positioned over the nose and mouth of the user. The elastic band 16 also maintains the position of the filter panel 14 over the nose and mouth. One skilled in the art will understand that the respirator mask 12 could include alternative elements for holding the filter panel 14 in place on a user's face, such as a string which can be tied at the back of a user's head. Examples of these respirator masks 12 include, but are not limited to, 3M Company's commercially available 1800+, 1816, 1818, 1820, 1825, 1826, 1838, and 1860 respirator masks.

As shown in FIG. 1, the filter panel 14 has an exterior surface 22 which faces away from a user when the respirator mask 12 is placed onto the user's face. The exterior surface 22 is typically a single color such as blue, and technical information 24 about the filter panel 14 may be printed on the exterior surface 22. The filter panel 14 is generally shaped to be convex, allowing room for a user's lips and nose within the confines of the respirator mask 12. The filter panel 14 also includes a perimeter edge 26, where the elastic band 16 is coupled to the filter panel 14. In one embodiment, strips of a first fastener material 28 are adhesively attached to the exterior surface 22 along this perimeter edge 26. For example, the first fastener material 28 can be a hook and loop fastener, such as VELCRO® material, or an adhesive, such as GLUE DOTS® material.

As illustrated in FIG. 1, the decorative cover 10 is adapted to fit over, and be engaged with, the exterior surface 22 of the respirator mask 12. In one embodiment, the decorative cover 10 is formed from a fabric panel 30 including a first or upper portion 32 and a second or lower portion 34, with each portion 32, 34 being made from a substantially non-filtering fabric material. Unlike the filter fabric in the filter panel 14, the fabric panel 30 of the decorative cover 10 is not specially designed to remove infectious contaminants and particles from the air traveling through the fabric panel 30. Rather, the cover 10 permits air and relatively small particles and the like to pass through the cover so that the filtering capability of the underlying respirator mask 12 will capture the small particles while air is permitted to enter the user's nose and mouth.

Figure 2:
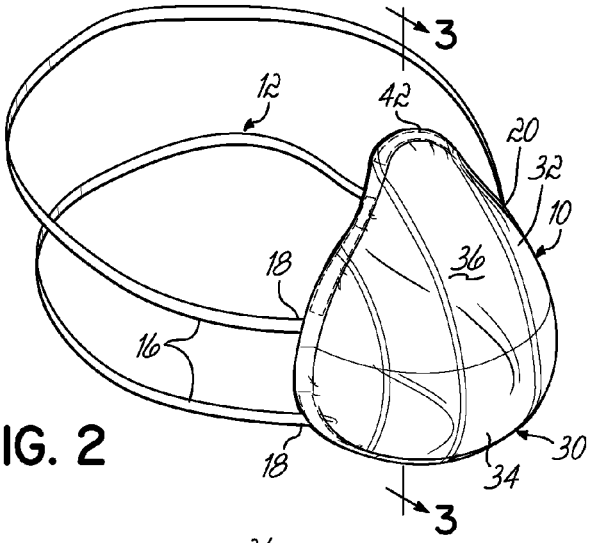
FIG. 2 is a front perspective view of the decorative cover and respirator mask of FIG. 1, with the cover engaged with the mask.

As shown in FIGS. 1 and 2, the upper and lower portions 32, 34 each have an exterior surface 36 and an interior surface 38. The exterior surface 36 can be monochrome, or the exterior surface 36 can include a printed design as is typical on quilting fabrics. Alternatively, the design may be decorative, with the design being applied to the exterior surface 36 of the cover 10 in any well known manner.

In the embodiment of FIG. 1, each portion 32, 34 is generally oval-shaped with pointed ends when laid flat. Each portion 32, 34 has a center seam edge 40 and an outer perimeter edge 42. The first portion 32 also includes a pair of darts 44 sewn into and extending from the outer perimeter edge 42. The decorative cover 10 is assembled by stitching together the center seam edges 40 of the first portion 32 and the second portion 34. The generally oval shape of the first and second portions 32, 34 and the darts 44 allow the decorative cover 10 to assume the convex shape of the respirator mask 12. Along the outer perimeter edges 42 of the decorative cover 10, strips of a second fastener material 46 such as VELCRO® material or GLUE DOTS® material, are adhesively coupled to the interior surface 38. This second fastener material 46 is adapted to releasably attach to the first fastener 28 on the respirator mask 12.

Figure 3:
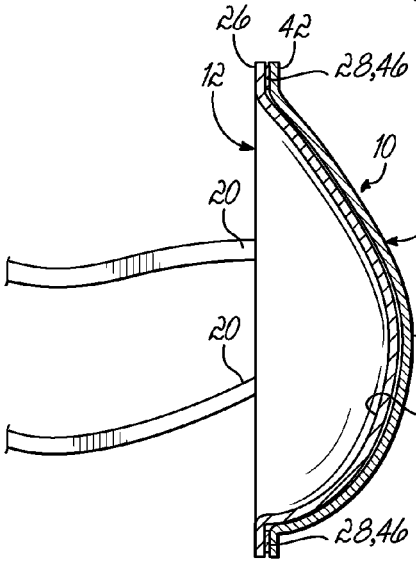
FIG. 3 is a cross-sectional side view of the decorative cover and respirator mask of FIG. 1.

Once the decorative cover 10 is fully assembled, the decorative cover 10 is attached to the respirator mask 12 as indicated by arrow 48 in FIG. 1. The combined decorative cover 10 and respirator mask 12 is illustrated in FIGS. 2-3. The decorative cover 10 is placed onto the respirator mask 12 so that the second fastener 46 on the interior surface 38 of the decorative cover 10 engages the first fastener 28 on the exterior surface 22 of the respirator mask 12. The decorative cover 10 is therefore releasably locked into position on the respirator mask 12, covering the bland exterior surface 22 of the respirator mask 12 with the fabric or decorative design provided on the exterior surface 36 of the decorative cover 10.

As described above, the decorative cover 10 is formed from a substantially non-filtering fabric material. Consequently, the decorative cover 10 does not affect the filtration characteristics of the underlying respirator mask 12. Advantageously, the first and second fasteners 28, 46 allow the decorative cover 10 to be removed for washing or sterilization after its use. The decorative cover 10 can then be re-used on the same or another respirator mask 12, or a decorative cover 10 with an alternative fabric or other decorative design provided on the exterior surface 36 may be placed on the same respirator mask 12. In this manner, a mask user can customize the appearance of the respirator mask 12 and improve the overall aesthetics while keeping all the functionality of regular respirator masks 12. These features will encourage hospital patients and visitors to continuously use the respirator mask 12 while in the presence of a contagious and infectious airborne disease.

While the present invention has been illustrated by a description of a preferred embodiment and while this embodiment has been described in some detail, it is not the intention of the Applicant to restrict or in any way limit the scope of the appended claims to such detail. For example, the decorative cover 10 could be attached to a protective mask (not shown) that is commonly used in the construction and painting industries to filter out dust and paint particles, in order to improve the appearance of protective masks in those fields. Additional advantages and modifications will readily appear to those skilled in the art. The various features of the invention may be used alone or in any combination depending on the needs and preferences of the user. This has been a description of the present invention, along with the preferred methods of practicing the present invention, as currently known. However, the invention itself should only be defined by the appended claims.

What is claimed is:

1. A decorative cover for a respirator mask having a filter panel and a securement mechanism attached to the filter panel for positioning the respirator mask on a user's face, comprising:

a fabric panel formed from a substantially non-filtering fabric material having an interior surface;

a first fastener coupled to the interior surface of the fabric panel; and a second fastener coupled to an exterior surface of the respirator mask, wherein the first and second fasteners are configured to be releasably coupled together so that the fabric panel is releasably coupled to the respirator mask by engaging the first and second fasteners together with the fabric panel substantially covering the filter panel of the respirator mask, and further wherein, when the fabric panel is uncoupled from the respirator mask, the first fastener is coupled to the interior surface of the fabric panel and the second fastener is coupled to the exterior surface of the respirator mask such that the decorative cover may be removed from the respirator mask without detaching the securement mechanism from the filter panel.

2. The decorative cover of claim 1, wherein the fabric panel further comprises:

an exterior surface having a design thereon adapted to improve an appearance of the decorative cover and respirator mask combination.

3. The decorative cover of claim 1, wherein the fabric panel further comprises:

a first fabric panel portion having:

a first center seam edge; and a first outer perimeter edge, a second fabric panel portion having:

a second center seam edge; and a second outer perimeter edge, wherein the first fabric panel portion and second fabric panel portion are stitched together at the respective first and second center seam edges.

4. The decorative cover of claim 3, wherein the upper portion further comprises:

at least one dart extending from at least one of the outer first and second perimeter edges, the at least one dart adapted to adjust a shape of the decorative cover to fit onto the respirator mask.

5. A decorative cover for a respirator mask having a filter panel and a securement mechanism attached to the filter panel for positioning the respirator mask on a user's face, comprising:

a fabric panel formed from a substantially non-filtering fabric material having an inner surface;

a first fastener associated with the fabric panel; and a second fastener associated with the respirator mask, wherein the first and second fasteners are configured to be releasably coupled together so that the fabric panel is releasably coupled to the respirator mask by engaging the first and second fasteners together with the fabric panel substantially covering the filter panel of the respirator mask with the interior surface of the fabric panel facing an exterior surface of the respirator mask, and further wherein, when the fabric panel is uncoupled from the respirator mask, the first fastener is coupled to the fabric panel and the second fastener is coupled to the respirator mask such that the decorative cover may be removed from the respirator mask without detaching the securement mechanism from the filter panel.

6. The decorative cover of claim 5, wherein the fabric panel further comprises:

an exterior surface having a design thereon adapted to improve an appearance of the decorative cover and respirator mask combination.

7. The decorative cover of claim 5, wherein the fabric panel further comprises:

a first fabric panel portion having:

a first center seam edge; and a first outer perimeter edge, a second fabric panel portion having:

a second center seam edge; and a second outer perimeter edge, wherein the first fabric panel portion and second fabric panel portion are stitched together at the respective first and second center seam edges.

8. The decorative cover of claim 7, wherein the upper portion further comprises:

at least one dart extending from at least one of the first and second outer perimeter edges, the at least one dart adapted to adjust a shape of the decorative cover to fit onto the respirator mask.

* * * * *